US008082670B2

(12) United States Patent
Burghardt et al.

(10) Patent No.: US 8,082,670 B2
(45) Date of Patent: Dec. 27, 2011

(54) SHAVING HEAD FOR AN ELECTRIC SHAVER

(75) Inventors: Renata Burghardt, Kronberg (DE); Martin Kluge, Floersheim am Main (DE); Ricardo Hojczyk, Praha (CZ); Andre Nauber, Frankfurt am Main (DE); Werner Dalitz, Bad Neuheim (DE); Luis Burrel Diez, Frankfurt am Main (DE); Uwe Schaaf, Alsbach-Hachnlein (DE); Dietmar Korn, Eschborn (DE); Andreas Moehring, Kronberg (DE)

(73) Assignee: Braun GmbH, Kronberg (DE)

( * ) Notice: Subject to any disclaimer, the term of this patent is extended or adjusted under 35 U.S.C. 154(b) by 808 days.

(21) Appl. No.: 11/996,575

(22) PCT Filed: Jul. 22, 2006

(86) PCT No.: PCT/EP2006/007231

§ 371 (c)(1),
(2), (4) Date: Jul. 22, 2008

(87) PCT Pub. No.: WO2007/014660

PCT Pub. Date: Feb. 8, 2007

(65) Prior Publication Data

US 2009/0133265 A1 May 28, 2009

(30) Foreign Application Priority Data

Jul. 29, 2005 (DE) ..... 10 2005 036 383

(51) Int. Cl.
*B26B 19/04* (2006.01)

(52) U.S. Cl. ..... 30/346.51; 30/43.9; 30/43.92

(58) Field of Classification Search ..... 30/43.5, 30/43.6, 43.8, 43.9, 43.1, 43.92, 346.519, 30/346.51

See application file for complete search history.

(56) References Cited

U.S. PATENT DOCUMENTS

| | | | | |
|---|---|---|---|---|
| 2,206,551 | A * | 7/1940 | Muros | 30/43.92 |
| 2,824,367 | A * | 2/1958 | McWilliams | 30/41.5 |
| 3,002,276 | A * | 10/1961 | Kobler | 30/43.92 |
| 3,064,348 | A * | 11/1962 | Wahl | 30/43.92 |
| 4,012,837 | A | 3/1977 | Ascoli | |
| 4,343,089 | A * | 8/1982 | Suzuki et al. | 30/346.51 |
| 5,473,818 | A * | 12/1995 | Otsuka et al. | 30/43.9 |
| 5,802,932 | A * | 9/1998 | Vankov et al. | 76/104.1 |
| 5,857,260 | A * | 1/1999 | Yamada et al. | 30/346.51 |
| 6,637,113 | B2 * | 10/2003 | Ikuta et al. | 30/43.92 |
| 6,951,056 | B2 * | 10/2005 | Kameoka et al. | 30/346.51 |
| 7,055,246 | B2 * | 6/2006 | Satoh et al. | 30/43.6 |
| 2006/0143924 | A1 * | 7/2006 | Mercurio | 30/43.91 |

(Continued)

FOREIGN PATENT DOCUMENTS

DE 25 31 441 2/1976

(Continued)

*Primary Examiner* — Hwei C Payer

(74) *Attorney, Agent, or Firm* — Kelly L McDow; Jay A Krebs

(57) ABSTRACT

A shaving head for an electric shaving apparatus, having an under cutter comprising at least one blade which is drivable in at least one direction of movement relative to an outer cutter. To achieve a good shaving result while at the same time protecting the skin to be best possible effect, it is proposed providing the blade with an outer boundary section which is raised in relation to the cutting edge, faces in the direction of the outer cutter and inclines upwardly from the cutting edge toward the outer cutter.

3 Claims, 3 Drawing Sheets

U.S. PATENT DOCUMENTS

2011/0067244 A1* 3/2011 Eichhorn et al. ..... 30/43.92

FOREIGN PATENT DOCUMENTS

| | | | |
|---|---|---|---|
| DE | 43 39 918 | A1 | 5/1994 |
| DE | 44 23 503 | C1 | 4/1995 |
| DE | 603 00 190 | T2 | 4/2005 |
| EP | 0 743 144 | B1 | 10/2000 |
| EP | 1 182 014 | A2 | 2/2002 |
| EP | 1 418 027 | A1 | 5/2004 |
| JP | 51-16151 | A | 2/1976 |
| JP | 7-148361 | A | 6/1995 |
| JP | 2005-058561 | A | 3/2005 |
| JP | 2005-168631 | A | 6/2005 |
| WO | WO 2007/134672 | A1 * | 11/2007 |

* cited by examiner

Fig. 2
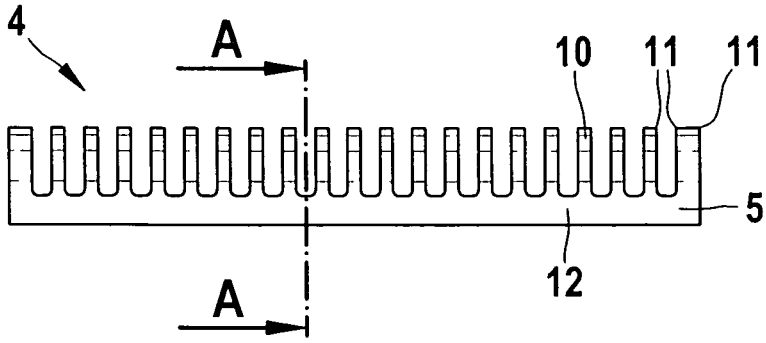
Fig. 3
(A-A)
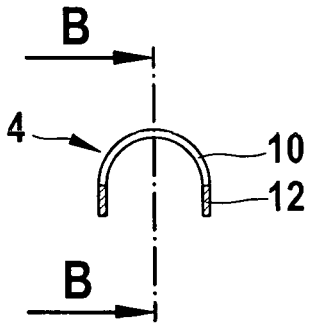
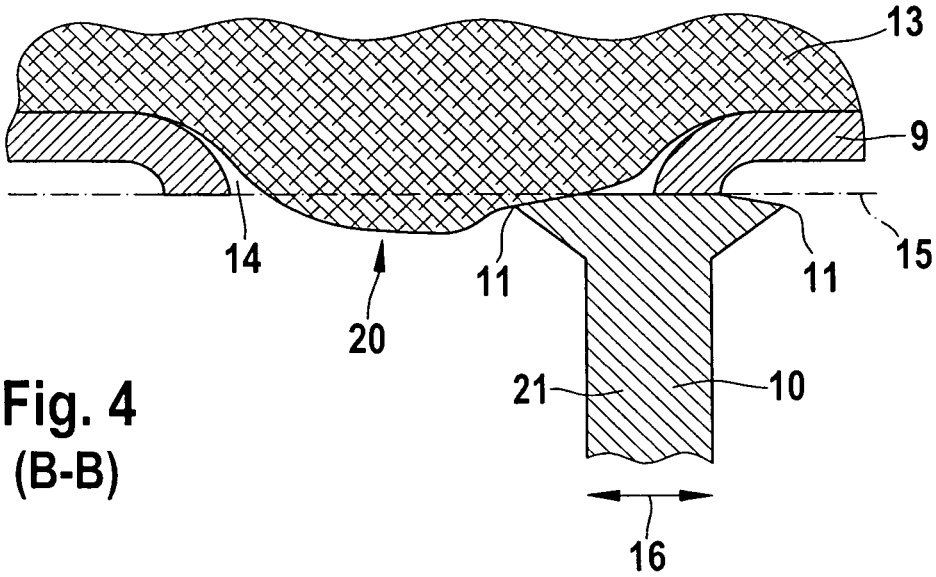
Fig. 4
(B-B)

(B-B)

SHAVING HEAD FOR AN ELECTRIC SHAVER

TECHNICAL FIELD

This application relates to a shaving head for an electric shaving apparatus.

BACKGROUND

EP-B-0 743 144 discloses a shaving head formed from a combination of an under cutter and an outer cutter. The outer cutter of the shaving head is constructed as a perforated foil and cooperates with an under cutter formed from a plurality of blades, with the cutting edges of the individual blades having a cutting angle of less than 90°. DE-C-44 23 503 discloses an under cutter for a shaving head on which the blades have a cutting edge angle of 90°.

Whether constructed as a rotary or an oscillatory system, the outer cutter and under cutter, being at least partly in direct contact with each other, cooperate. Shaving apparatus on which the under cutters are equipped with so-called 90° cutting edges are typically characterized by optimum skin protection, whereas under cutters with a cutting edge angle of less than 90° are typically characterized as having a somewhat better "stroking action" on account of the lower cutting forces. Dry shaving can be accompanied by skin irritations on account of interactions between the under cutter and the skin which arches into the shearing apertures of the outer cutter. When using cutting edges with a cutting angle of 90°, the skin can be urged undamaged back out of the shearing aperture of the outer cutter, but in the case of a sharp cutting edge with a small edge radius and a smaller cutting edge angle the skin may be injured or at least irritated. With so-called "sharp-edged" under cutters it is possible in principle to perform a more thorough shave because these cutters can also capture and shorten even the shortest hairs by incision.

SUMMARY

It is therefore an object of the present invention to preserve the advantages of the sharp-edged under cutters with regard to their low cutting forces while at the same time preventing skin irritations due to the shave and maintaining the superior skin protection of the cutting systems with a right-angled cutting edge.

This object is accomplished according to the present invention in that the blade has an outer boundary section, which is raised in relation to the cutting edge, faces in the direction of the outer cutter and inclines upwardly from the cutting edge toward the outer cutter.

Skin irritation effects occurring in connection with sharp-edged under cutters are affected by the blade angle which the foremost region of the outer leg of the cutting edge angle forms with the direction of movement of the edge or with the shear plane. Particularly critical with regard to skin irritations in this case are negative blade angles, meaning an approach of the cutting edge in the direction of the skin. Such negative blade angles can occur by bending of the under cutter on account of the cutting forces during the cutting of a beard hair, which is why it is also particularly important for under cutters with a sharp-edged blade to be constructed with sufficient mechanical stability. Even very small alterations of angle in the range of around 5° can have a huge influence on the occurrence of skin irritations.

The shaving head disclosed here can be used in a wide variety of types of electric shaving apparatus, with a particular advantage being afforded if the under cutter includes a plurality of blades. In particular when used in oscillatory shaving systems it is advantageous for the at least one blade to have two mutually opposite cutting edges. With regard to low cutting forces, the associated lower energy consumption of the dry shaving apparatus and an excellent stroking action, it is an advantage for the edge angle of the cutting edge formed by the inner and outer leg of the edge angle to be smaller than or equal to 90°, whereby it has been discovered that an optimum shaving performance can be achieved with edge angles of between 20° and 90°, preferably around 45°. Where oscillatory shaving systems are used, the lower cutting forces also prevent the risk of oscillation dips due to high loading.

Of course, the shaving results are also greatly influenced by the radius of the cutting edge, with excellent shaving results being achieved with edge radii smaller than or equal to 2 μm, preferably smaller than or equal to 1 μm.

Advantageously, the difference in height between the outermost point of the raised boundary section and the cutting edge amounts to between 1 μm and 20 μm. In this arrangement it should be noted that excessively large gaps between the under cutter and the outer cutter can lead to a possibility of the hair to be shaved being pulled in between the two shaving parts, which can result in a painful plucking effect, which is to be avoided.

A preferred embodiment of the invention provides for the blade angle, meaning the angle between the direction of movement of the under cutter and the outer leg of the edge angle, to amount to between 20° and 1°, preferably between 2° and 5°. Optimum protection of the skin is thus achieved, and it is assured that no blade angles in the direction of the skin can arise even if the under cutter should bend.

The outer boundary line, meaning the line extending between the cutting edge and the raised region, can be constructed to be linear or at least partly cambered. In this arrangement it is important for the contour of the outer boundary section to be continuous, meaning for it to have no jumps, in particular no jumps in height.

Another advantageous embodiment of the invention provides for the under cutter to be driven to rotate; yet another advantageous embodiment provides in contrast for an oscillatory drive, in particular a drive that oscillates linearly.

An embodiment affording particular economy of manufacture provides for the under cutter to be formed from a shaped piece of sheet metal, with preferably the under cutter or at least the cutting edge being manufactured by an etching process. With regard to the service life of the shaving part, it is particularly favorable for the blade to be equipped at least in part with an anti-wear coating.

Further objects, features, advantages and application possibilities of the present invention will become apparent from the subsequent description of the embodiments. Accordingly, all the features described or represented by illustration form, when taken alone or in any combination, the subject-matter of the present invention, and do so independently of their summary in the claims or their back reference.

DESCRIPTION OF DRAWINGS

FIG. 2 is a view of an individual cutting element of an under cutter.

FIG. 3 is a sectional view of a cutting element taken along the line A-A of FIG. 2.

FIG. 4 is a greatly enlarged view of the convergence of the under cutter, the outer cutter and the skin arched in through the outer cutter.

DETAILED DESCRIPTION

Figure 1:
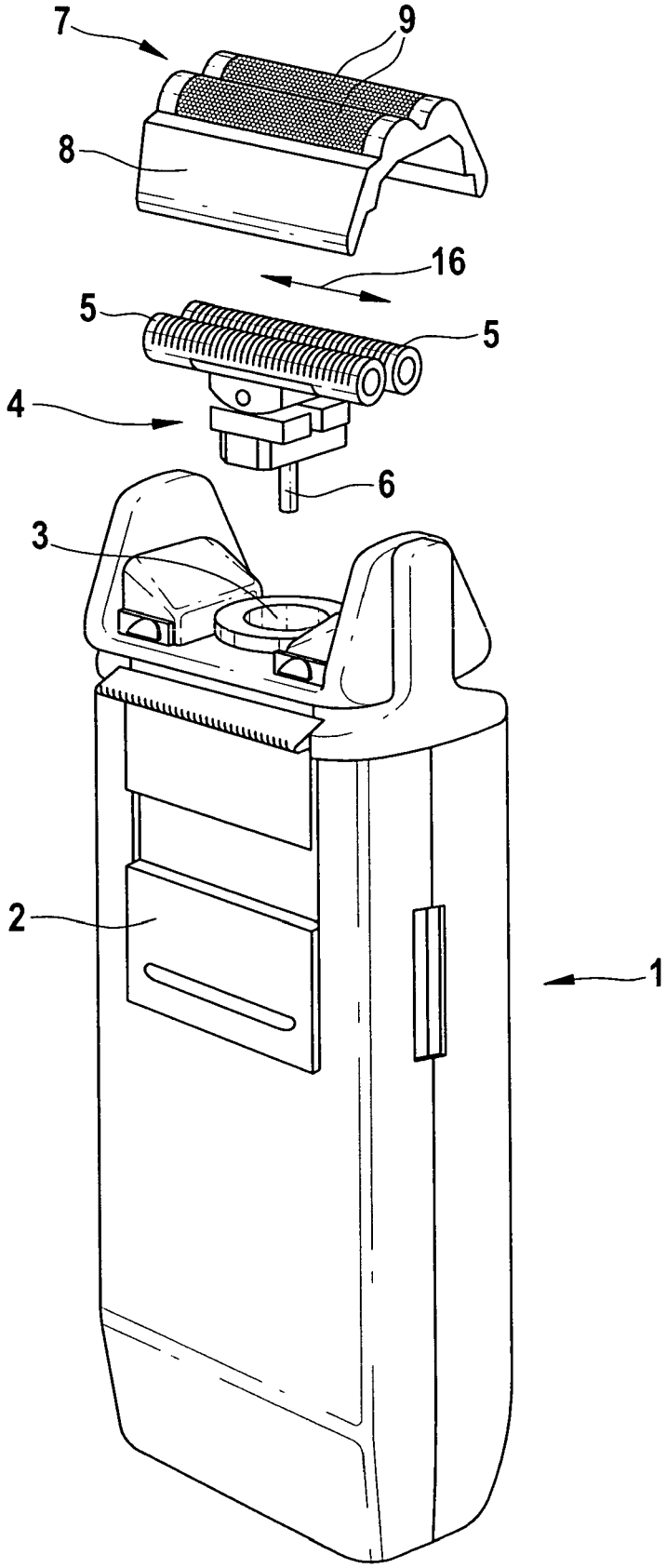
FIG. 1 is a schematic representation of a dry shaving apparatus.

The dry shaving apparatus shown in FIG. 1 includes a housing 1, which serves among other things to accommodate an electric motor and, if applicable, storage batteries for storing energy and is equipped with an on/off switch 2. Extending from the upper end of the housing 1 is a drive element 3 which is driven to oscillate. The under cutter 4, which includes the shaving elements 5, includes a coupling pin 6 which is adapted to be in locking engagement with the drive element 3. In this way the two mutually parallel shaving elements 5 can be driven in oscillatory fashion along their longitudinal extension (double arrow 16).

The under cutter 4 is embraced at least in part by an outer cutter 7 which is composed of an exchangeable frame adapted to be in locking engagement with the housing 1, and of shaving foils 9 mounted on the exchangeable frame 8. The shaving foils 9 have their surface areas perforated with apertures which can be constructed as holes and/or slits and through which the hairs to be shaved enter into the shaving heads during the shaving operation. On account of the cutting edges, which are constructed on the foil apertures as well as on the shaving elements 5 of the under cutter 4, and the movement of the under cutter 4 relative to the outer cutter 7, hairs which have entered the shaving heads are sheared off between the corresponding cutting edges.

FIG. 2 shows, in an enlarged representation, a shaving element 5 of the under cutter 4, on which a plurality of blades 10 is arranged—in this case parallel to each other. As becomes apparent from FIG. 3, the blades 10 of the under cutter 4 are constructed in a U-shaped configuration, whereby, at the free edges of the strip-shaped blades 10 bent to form a U, the cutting edges 11 also extend in arcuate manner and face away from each other. The strip-shaped section 12, which is aligned along the direction of movement of the under cutter 4, serves to fasten the shaving element 5 to a coupling element by means of which a connection to the drive mechanism is established.

Figure 5:
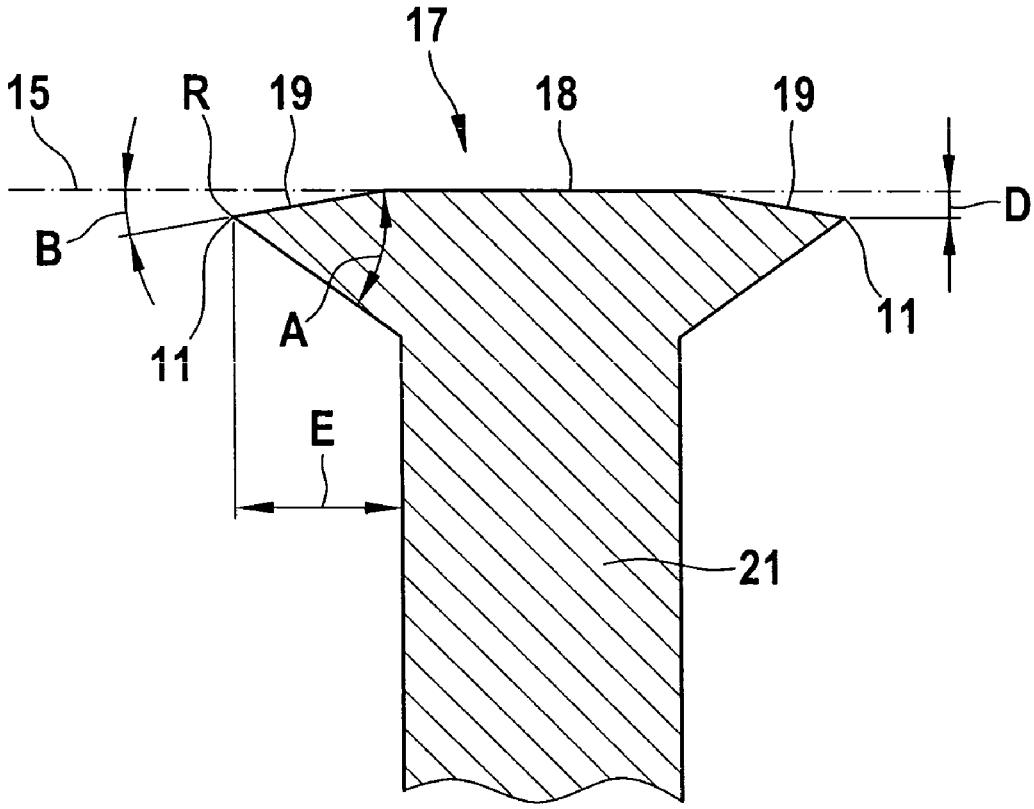
FIG. 5 is an enlarged view (corresponding approximately to a section taken along the line B-B of FIG. 3) of a blade element of the under cutter.

FIG. 4 shows the interaction between under cutter, outer cutter and the skin 13 to be shaved. It shows in this Figure how a section of the skin 13 is urged through an aperture 14 in the shaving foil 9 into the shaving head. For the sake of clarity the Figure shows only one blade 10 on whose outer contour the shaving foil 9 takes support, as the result of which the contact plane 15 is formed in this region. Extending parallel to the contact plane 15 is also the direction of movement 16 of the shaving element, which is indicated by the double arrow, with the blade 10 being driven to oscillate linearly. Unlike the embodiment of FIGS. 2 and 3, the blade illustrated in FIGS. 4 and 5 has a middle bar 21. This bar can be used, where applicable, to increase the mechanical stability.

The outer boundary section 17 of the blade 10, which extends between the two mutually opposite cutting edges 11, has a central raised portion 18 which is of plane construction and extends along the contact plane 15. Adjoining this portion are the outer lying bevels 19 which, starting from the cutting edges 11, extend to the central raised portion 18 at a blade angle B, i.e., upwards when viewing the drawing. This blade angle B has a magnitude of between 22° and 1°, preferably 2° to 5°. The edge radius R of the cutting edges 11 amounts to 2 μm or less, preferably even less than 1 μm. The edge angle A of the wedge-shaped cutting edges 11 amounts to 90° or less, an angle of 45°±10° having been found to be a preferred magnitude. The selected difference in height D between the raised portion 18 and the cutting edge 11 amounts to between 1 μm and 20 μm. If too big an angle were selected, there would be a risk of hair being drawn in between the shaving foil and the under cutter, as the result of which said hair is then not cut but only clamped or torn.

As becomes apparent from FIG. 4, as the result of the suitably selected blade angle B, the skin 13, which is arched through the shaving foil 9, is not incised in spite of the sharp-edged cutting edge 11 but can be pushed, upon movement of the blade 10 and simultaneous formation of a bead of skin 20, over the outer boundary section 17 of the blade 10 and, where applicable, can even be urged back out of the aperture 14 of the shaving foil 9 at least into the region of the contact plane 15. As this occurs, a hair which might exist on this section of skin can be sheared off nevertheless. In this way it is possible to ensure a shave which protects the skin and is thorough nevertheless. In addition, the described embodiment of the outer boundary section 17 of the blade 10 results in a longer service life of the cutting edges 11 because the cutting edges themselves do not make frictional contact with the shaving foil 9 as would be the case without the pronounced blade angle B. As the result, frictional loss is minimized, thus leading to a saving of energy or to a longer running time in battery mode.

Selecting an edge angle A of approximately 45° represents a compromise between the required stability of the cutting edge and cutting forces which nevertheless are still as low as possible. While excessively large edge angles do not sever the hairs optimally, wedge angles which are too small lead to stability problems such as edge cracks or local edge bends.

The edge protrusion E of the cutting edge 11, i.e., the extension of the cutting wedge along the direction of movement 16, should amount to more than 50 μm, if possible even 100 μm or more. This ensures that the wedge of the cutting edge 11 can penetrate completely into the hair and sever it in the process.

Finally it should be noted that the transition from the cutting edge 11 to the central raised portion 18 of the outer boundary section does not necessarily have to be effected with contours extending straight in the cross section; also possible is a cambered design of the outer boundary section, on which the transition 19 is not constructed as a beveled contour but as a contour curved in convex fashion. However, it must be assured in this configuration that this convex contour extends substantially within the indicated edge angles A.

What is claimed is:

1. A shaving head for an electric shaving apparatus, the shaving head comprising an under cutter comprising at least one blade drivable in at least one direction of movement relative to an outer cutter that embraces the blade at least in part, the blade being equipped with at least one cutting edge facing in the direction of movement, wherein: (a) the blade comprises an outer boundary section that is raised in relation to the cutting edge, faces in the direction of the outer cutter, and inclines upwardly from the cutting edge toward the outer cutter; and (b) the outer boundary section comprises an outermost point having a height of between 1 μm and 20 μm with respect to the cutting edge.

2. A shaving head for an electric shaving apparatus, the shaving head comprising an under cutter comprising at least one blade drivable in at least one direction of movement relative to an outer cutter that embraces the blade at least in part, the blade being equipped with at least one cutting edge facing in the direction of movement, wherein: (a) the blade comprises an outer boundary section that is raised in relation to the cutting edge, faces in the direction of the outer cutter, and inclines upwardly from the cutting edge toward the outer cutter; and (b) the cutting edge defines an outer leg of the edge angle and forms an angle between 1° and 22° with respect to the direction of movement of the under cutter.

3. The shaving head of claim 2, wherein the angle is between 2° and 5°.

* * * * *